United States Patent [19]

Cosco et al.

[11] 4,047,064

[45] Sept. 6, 1977

[54] FLASH TUBE HAVING ENCLOSED TRIGGER WIRE

[75] Inventors: Robert J. Cosco, Amesbury; Joseph V. Lima, Salem; Frank Soucy, Danvers, all of Mass.

[73] Assignee: GTE Sylvania Incorporated, Danvers, Mass.

[21] Appl. No.: 696,667

[22] Filed: June 16, 1976

[51] Int. Cl.[2] ..... H01J 65/00

[52] U.S. Cl. ..... 313/201; 313/198

[58] Field of Search ..... 313/201, 166, 234, 15; 329/188

[56] References Cited

U.S. PATENT DOCUMENTS

| | | | |
|---|---|---|---|
| 2,542,345 | 2/1951 | Miles | 313/201 |
| 3,840,766 | 10/1974 | Pappas et al. | 313/178 |

*Primary Examiner*—Rudolph V. Rolinec
*Assistant Examiner*—Darwin R. Hostetter
*Attorney, Agent, or Firm*—James Theodosopoulos

[57] ABSTRACT

A flash tube has an hermetically sealed glass envelope containing an inert gas and a pair of electrodes between which an arc discharge path is defined during lamp operation, and an external trigger wire which is embedded within a glass tube which, in turn, is fused to the outer surface of the envelope.

2 Claims, 3 Drawing Figures

FLASH TUBE HAVING ENCLOSED TRIGGER WIRE

THE INVENTION

This invention relates to pulsing electric discharge flash tubes. Such tubes generally comprise two spaced apart electrodes within a sealed glass envelope having an inert gas fill, typically xenon, at a subatmospheric pressure. The invention is particularly concerned with tubes having an external trigger wire wrapped around the envelope, such as is shown in U.S. Pat. No. 3,840,766, the disclosure of which is incorporated herein by reference.

In some cases it is undesirable for the external trigger wire to be exposed, since an external arc could occur between the trigger wire and a proximate grounded object, such as the fixture on which the lamp is mounted. It is the purpose of this invention to provide a lamp in which the occurrence of such an external arc is substantially prevented.

Figure 1:
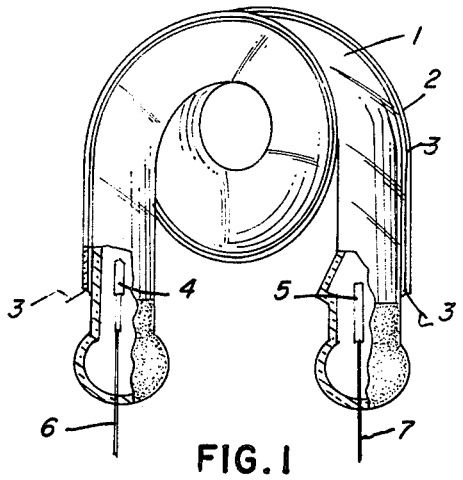
Figure 2:
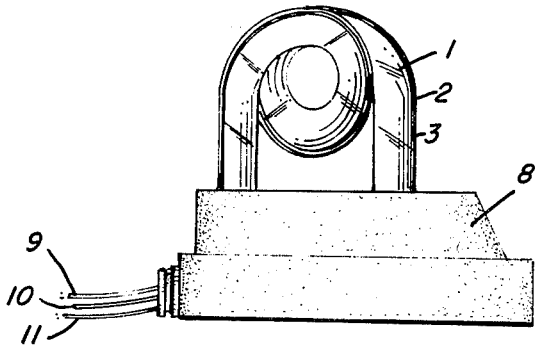

In the drawing, FIG. 1 is an elevational view of a lamp in accordance with this invention prior to embedment and FIG. 2 shows the lamp after embedment.

Figure 3:
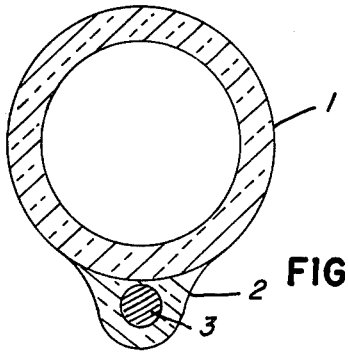

FIG. 3 is an enlarged cross-sectional view.

In a lamp in accordance with this invention, the external trigger wire is embedded in a glass tube which is fused to the glass envelope.

In one embodiment, as shown in the drawing, the flash tube comprised an hermetically sealed envelope 1 formed of a helically shaped three and a half inch length of 4 mm by 6 mm hard glass tubing, for example, No. 7740 glass. Fused to the outer surface of envelope 1 was a shorter length of suitable smaller diameter glass tubing 2 in which trigger wire 3 was embedded. Sealed within the ends of envelope 1 were a cathode electrode 4 and an anode electrode 5. Envelope 1 was filled with an inert gas, typically xenon, at a subatmospheric pressure, for example, 120 torr. Electrodes 4 and 5 can be energized via lead-in wires 6 and 7 which are sealed through respective ends of glass envelope 1.

Trigger wire 3 was 8 mil tungsten wire and was enclosed within glass tubing 2 which was 85 mils O.D. by 35 mils I.D. Glass tubing 2 consisted of No. 3320 glass the coefficient of expansion of which is intermediate that of tungsten and the 7740 glass and yet is sufficiently close to both to permit sealing thereto.

The ends of envelope 1 were embedded in a suitable electrically insulative rubber or plastic 8 which extended above the ends of glass tubing 2; thus, no part of trigger wire 3 was exposed to the atmosphere. Within embedment 8, wires 3, 6 and 7 were connected to external lead-in wires 9, 10 and 11 so that an anode voltage, say, 300 to 500 volts dc, could be applied between electrodes 4 and 5 and a trigger pulse having, say, a 4000 volt peak, could be applied to trigger wire 3.

We claim:

1. In a flash tube having an hermetically sealed glass envelope containing an inert gas and a pair of electrodes between which an arc discharge path is defined during lamp operation, the improvement which comprises a tungsten trigger wire embedded within a glass tube which is fused to the outer surface of the envelope, the coefficient of expansion of the glass tube being intermediate that of the tungsten trigger wire and that of the glass envelope.

2. The lamp of claim 1 wherein the ends of the glass tube do not extend as far as the ends of the envelope and the ends of the tube and of the envelope are embedded within an electrically insulative material so that no portion of the trigger wire is exposed to the surrounding atmosphere.

* * * * *